United States Patent [19]

Meng

[11] 4,417,426

[45] Nov. 29, 1983

[54] SUPPORT SYSTEM

[75] Inventor: Donald L. Meng, Simi Valley, Calif.

[73] Assignee: Quakebrace, Inc., Simi Valley, Calif.

[21] Appl. No.: 246,440

[22] Filed: Mar. 23, 1981

[51] Int. Cl.[3] ..... E04D 15/00

[52] U.S. Cl. ..... 52/126.7; 52/167; 52/299

[58] Field of Search ..... 52/126.7, 126.6, 126.5, 52/126.1, 167, 169.9, 169.12, 23, DIG. 11, 299, 292

[56] References Cited

U.S. PATENT DOCUMENTS

| | | | |
|---|---|---|---|
| 2,540,622 | 2/1951 | Langenberg | 52/126.7 |
| 2,968,841 | 1/1961 | Vance | 52/126.7 |
| 3,152,366 | 10/1964 | McCrory | 52/126.7 |
| 3,606,704 | 9/1971 | Benton | 52/126.6 |
| 4,014,517 | 3/1977 | Keagle | 52/126.1 |
| 4,148,162 | 4/1979 | Goodrich | 52/23 |
| 4,261,149 | 4/1981 | Gustafson | 52/DIG. 11 |

*Primary Examiner*—John E. Murtagh
*Assistant Examiner*—Henry E. Raduazo
*Attorney, Agent, or Firm*—Spensley, Horn, Jubas & Lubitz

[57] ABSTRACT

A support system for structures such as mobile homes, trailors and the like comprising two main support members, each having two legs supported by a base and with a clamping means at the top thereof. The height of the legs is adjustable by means of bolts which extend upwardly from the base, there being nuts on the bolts which support the two legs. There are also provided two cross-braces which interconnect and further support the two main support members as well as a stabilizer for providing support in the plane perpendicular to the plane of the cross-braces.

2 Claims, 6 Drawing Figures

SUPPORT SYSTEM

BACKGROUND OF THE INVENTION

1. Field of the Invention

This invention relates to support systems for structures such as mobile homes, trailers and the like, and more particularly, to an improved height adjustable and stable design thereof.

2. Prior Art

Even in mild earthquakes, structures such a mobile homes and trailers are frequently severely damaged. Such structures may be shaken from their fragil piers, which may even smash upward through the floors, causing extensive interior damage and possibly injury to occupants. Sewer, gas and electric lines can also rupture as the structures roll forward on their wheels or tires, bending and crushing the piers beneath them as they crash to the ground. Similar devastation can occur as a result of tornados, hurricanes or abnormally high winds. There are several devices currently available designed to better anchor and support such structures to avoid such damage. However, it is believed that none of the available systems is able to adequately satisfy all the important criteria for such a support which are indicated below.

Of course, the most important feature is strength. Ideally, such strength should be combined with simplicity such that the device is easy to handle and not overly cumbersome. It is also desired that the height of each individual support be adjustable. This is because frequently after such support systems are installed, there will be uneven settling of the ground beneath the structure. In order to maintain the structure in a level configuration, it is necessary to be able to adjust the height individually of each support member in a system without the necessity of removing the structure from the support system. As a further feature, it is desired to to be able to secure such a support system to an I-beam or a J-beam. This is because most mobile homes and trailers come equiped with a frame of such beams on the underside thereof.

There are some devices available which meet one or two of these criteria, but none which fully satisfy all of the criteria of stength, adjustability, and convenience of use.

An example of such a prior art device can be found in U.S. Pat. No. 3,606,231 to Kilborn. The device taught by this patent is height adjustable and will attach to the frame of a mobile home. However, the device comprises only a single support column with a single guy-rod. This structure is not as strong as is frequently desired or necessary, nor does it provide much resistance to swaying.

Another example can be found in U.S. Pat. No. 3,830,024 to Warnke. The device taught by this patent is actually not height adjustable while it is attached to the structure that it is supporting. Also, it shares the deficiency of the Kilborn patent in that it is not very strong for its size and not particularly resistant to sway.

A further example is U.S. Pat. No. 3,407,548 to Russel. The support structure disclosed therein, is strong for its size. However, the height may not be adjusted readily and there is no teaching of a separate support structure for adding to already existent mobile homes.

As can be seen, none of the above prior art devices is able to provide the necessary strength while being simple and easy to use with the height of individual support members being adjustable while the device is in use.

BRIEF SUMMARY OF THE INVENTION

It is therefore an object of this invention to provide a support system for structures such as mobile homes, trailers and the like wherein the support system is strong and resistant to sway with the height of the support system being adjustable without requiring removal of the support system from under the structure.

It is a further object of this invention to provide a support system as described above wherein the support system is light weight and easily manageable.

It is yet another object of this invention to provide a support system as described above wherein the support system may be readily secured to the frame on the underside of such a structure.

Generally, the support system of the present invention comprises one or more pairs of support members interconnected by a pair of diagonal cross-braces. In one embodiment, each support member comprises two vertical tubular outer legs which slide over two inner support legs which are mounted on a base. There is a horizontal member disposed between the outer legs at the lower end thereof and a metal angle at the top end thereof for clamping the support member to the frame of the structure being supported.

The two support members of a pair are each disposed under a pair of generally parallel beams which comprise a portion of the frame of the structure. The beams are supported on top of the support members by the angles on top of the outer legs. The cross-braces are disposed such that one end of each cross-brace is secured to the base of one of the support members with the other end of each cross-brace extending to the top of other support member and being clamped therewith to the beam. The two cross-braces intersect at approximately the center points thereof. The length of the cross-braces may be adjusted depending on the distance between the beams of the frame of the particular structure being supported.

There are one or more adjusting bolts extending upwardly from the base through holes in the horizontal member of each support member. The adjusting bolts are threaded to receive nuts, one of which is disposed below the horizontal member and one of which is disposed above the horizontal member. The horizontal member is supported on the nut or nuts disposed on the adjusting bolts therebelow. By turning the lower nuts, the height of the horizontal member and thus the overall height of the support member may be adjusted. The outer legs may be further supported on the inner support legs by means of a series of holes vertically arranged in each of the outer legs such that at a variety of heights, one of the holes in said outer legs will be aligned with a hole in the support legs such that a pin may be inserted through the holes in each leg to provide further support.

Each of the support members is angled slightly toward the other support member such that their top ends are closer to each other than their bottom ends. Thus, the height of the support members may be adjusted without the necessity of changing the length of the cross-braces which lend support against swaying of the structure.

Further support against swaying of the structure in a direction perpendicular to the plane of the cross-braces is provided by one or more stabilizers which are disposed with one end secured to the base of each support member and the other end thereof secured to the frame of the structure at a point distal to the support member.

In another embodiment, each support member comprises a single, generally vertical, cylindrical leg. There is threading provided at each end of the cylindrical leg with the direction of threading of the two ends being opposed. An internally threaded cup is disposed in the base and is configured to cooperate with and support the bottom threaded end of the cylindrical leg. A similar internally threaded cup is disposed such that it depends from the clamping means attached to the frame of the structure and cooperates with the top threaded end of the cylindrical leg. The directions of rotation of the threads are such that rotation of the cylindrical leg in one direction causes both ends to screw further into each cup, thus decreasing the effective height of the device. Rotation of the cylindrical leg in the reverse direction causes each end to screw out of each cup, thus increasing the effective height of the device. A horizontal bar is disposed through the center of the cylindrical leg to facilitate such rotation.

The clamping means may also be varied as follows. A flat, rectangular, horizontal plate is disposed at the top of the cylindrical leg with the top cup being secured thereto. This plate supports the bottom surface of the I-beam of the frame. The plate extends beyond the edges of the I-beam. There are also provided two generally L-shaped members. The end of one leg of each L-shaped member is secured to each end of the rectangular plate which extends beyond the edge of the I-beam and the bottom flanged portion of the I-beam is pinched between the two L-shaped members and the rectangular plate.

By utilizing the design of the present invention, a very strong support system may be provided for structures such as mobile homes and trailers which is also relatively simple, light and easy to handle. Also, significant support is provided to prevent sway of the structure in any direction. Under the present invention, while retaining such strength and convenience characteristics, the support system is also height adjustable while it continues to support the structure. Without sacrificing any of the support or stabilization against sway, the height of each individual support member of the support system of the present invention may be adjusted to compensate for settling of the ground beneath the structure or other changes which affect the level attitude of the structure.

The novel features which are believed to be characteristic of the invention, both as to its configuration and method of operation, together with further objectives and advantages thereof, will be better understood from the following description considered in connection with the accompanying drawings in which a presently preferred embodiment of the invention is illustrated by way of example. It is to be expressly understood, however, that the drawings are for the purposes of illustration and description only, and are not intended as a definition of the limits of the invention.

DETAILED DESCRIPTION OF THE DRAWINGS

Figure 1:
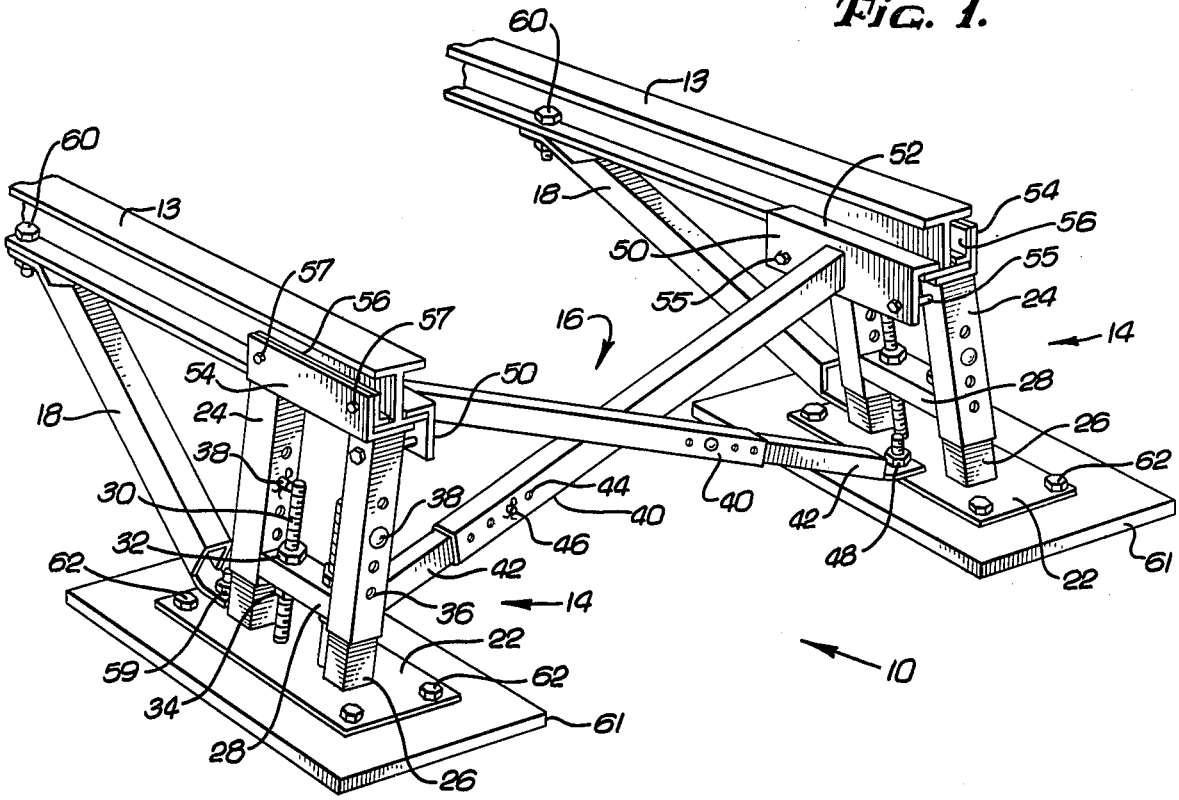
FIG. 1 is a perspective view of the support system of the present invention.
Figure 2:
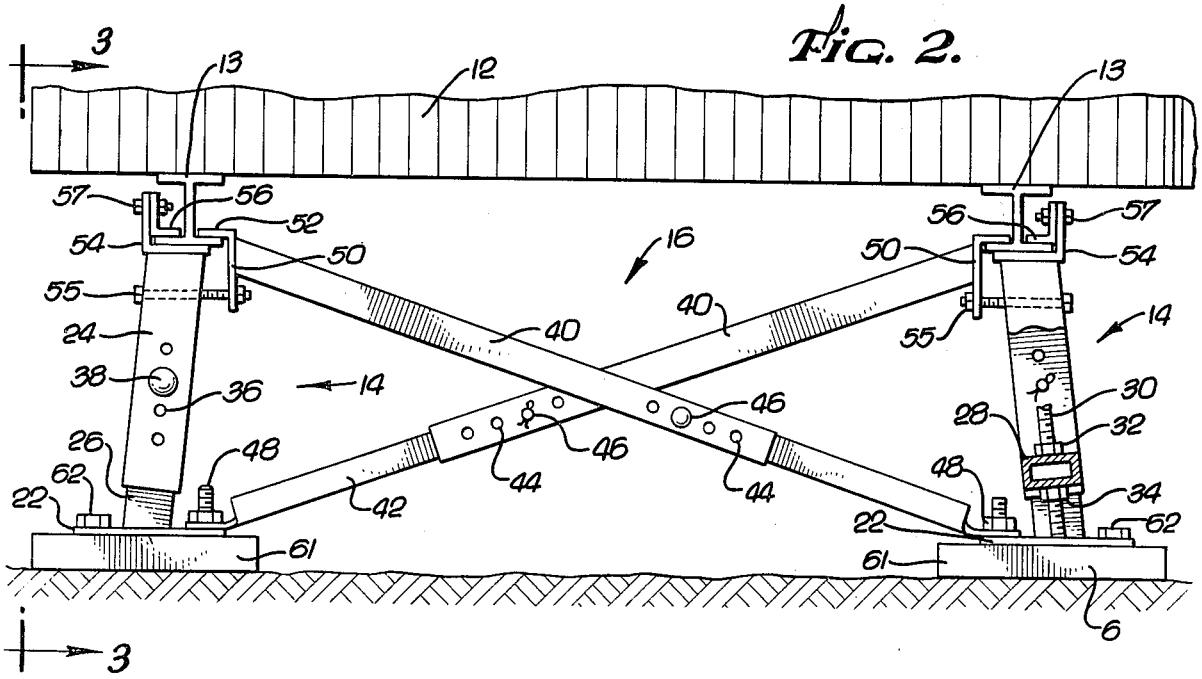
FIG. 2 is an elevational, partially cut-away view of the support system of the present invention as viewed from one end of the structure.
Figure 3:
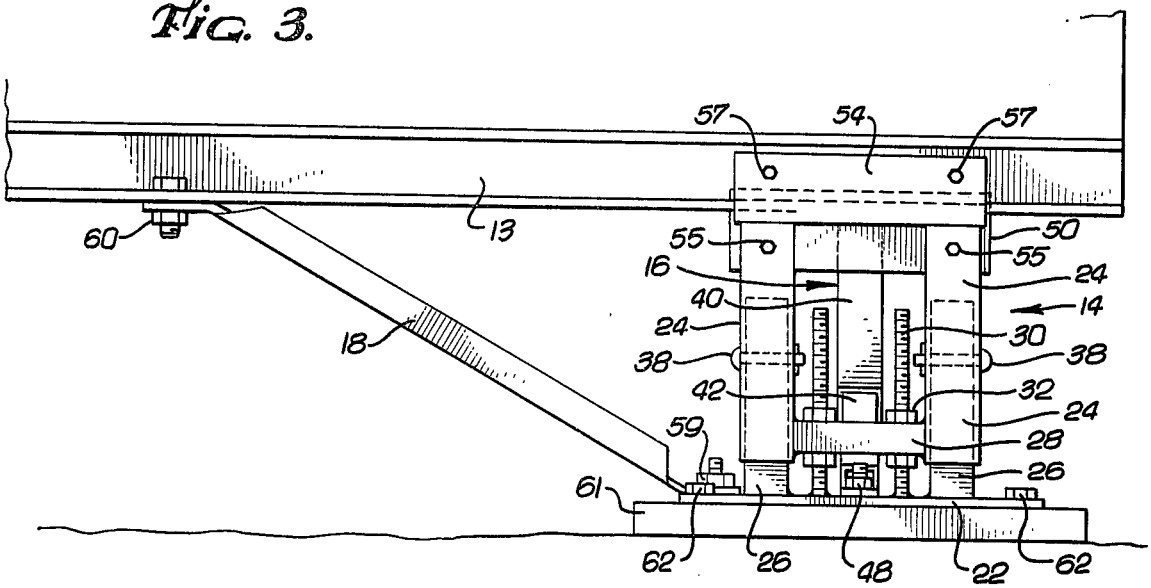
FIG. 3 is an elevational view of the support system of the present invention as viewed from one side of the structure.

Referring to FIGS. 1, 2 and 3, there is shown the support system 10 of the present invention. The support system 10 is designed to support structures such as mobile homes, trailers and the like. Such structures 12 are generally provided with a frame 13 which comprises a number of I-beams or J-beams or the like. The embodiment described hereinbelow is for use with a frame comprising I-beams. It is within the scope of the present invention to make minor modifications, well known in the art, to adapt the support system 10 for use with other types of frames.

The support system 10 of the present invention generally comprises a pair of support members 14 which are interconnected by a pair of diagonal cross-braces 16. There may also be provided a stabilizer 18 secured to the base 22 of each of the support members 14 which extends diagonally upward in a plane perpendicular to that of the cross-braces 16 to where it is clamped to the frame 13.

Each support member 14 generally comprises two or more tubular outer legs 24 which are coaxial with and slidably disposed over inner support legs 26. The inner support legs 26 extend upwardly from a base 22 of the support member 14. Disposed between the outer legs 24 at the lower ends thereof is a horizontal member 28. One or more adjusting bolts 30 extends upwardly from the base 22 through one or more holes in the horizontal member 28. The adjusting bolts 30 are threaded to receive nuts. An upper nut 32 is disposed above the horizontal member 28 and a lower nut 34 is disposed below the horizontal member 28. The lower nuts 32 support the horizontal member 28 and thus the outer legs 24. The height of the horizontal member 28 and thus the outer legs 24 may be adjusted by rotating the upper and lower nuts 32 and 34 to the desired position on the adjusting bolts 30.

Disposed in two opposing sides of each outer leg 24 are a plurality of holes 36 arranged in a vertical line. The holes 36 are disposed such that at a variety of heights of the outer legs 24 one of said holes 36 will align with a hole which is disposed through the inner support leg 26 so that a pin 38 may be placed through one of the holes 36 in the outer leg 24, through the hole in the inner support leg 26 and out a hole 36 in the opposing sides of the outer leg 24 to further support the outer legs 24 at a variety of heights on the inner support legs 26.

The cross-braces 16 generally comprise a tubular outer cross-brace member 40 and an inner cross-brace member 42. The inner cross-brace 42 member is slideably disposed partially within the outer cross-brace member 40 so that the overall length of each cross brace may be adjusted. A plurality of holes 44 are disposed through the outer cross-brace member 40 to align with a hole in the inner cross brace member 42 so that at a variety of lengths, a pin 46 may be placed through a hole 44 in the outer cross-brace member 40 and through the hole in the inner cross-brace member 42 to thereby secure the length of each cross-brace 16.

The cross-braces 16 are disposed such that one end of each cross-brace 16 is secured to the base 22 of one of the support members 14 by a bolt 48. Each cross-brace 16 extends diagonally upwardly to the top of the other support member 14. There is a clamp 50 disposed at the upper end of each cross-brace 16 with a horizontally extending flange 52 at the top end of the clamp 50. These cross-braces 16 provide extra strength and stability for the support system 10 of the present invention while not adding unduly to the bulk or complexity of the device or adversely affecting the adjustability of the height.

At the top of the outer legs 24 of the support member 14 is disposed an L-shaped angle 54 configured to support the frame 13 on the horizontal leg of the angle 54 with the vertical leg of the angle 54 abutting one edge of the frame 13. One possible means of attachment to an I-beam type frame 13 is illustrated in the figures is as follows. The frame 13 is supported by the horizontal leg of the angle 54 on the top of a outer leg 24 and the top of the support member 14. The flange 52 of the L-shaped clamp 50 attached to the cross-brace 16 rests on top of the lower flanged portion 53 of the frame 13. The edge flanged portion 53 of the frame 13 abuts the depending leg of the clamp 50. A bolt 55 extends through a hole in the outer leg 24 and through the depending leg of the clamp 50 thereby securing the clamp 50 from sideways movement and clamping the frame 13 between the depending leg of the clamp 50 on the cross-brace 16 and the vertical leg of the angle 54 on the support member 14. To secure the frame 13 from vertical movement, a second angle 56, smaller than the first angle 54 is secured to the vertical leg of the first angle 54 by bolts 57 such that the horizontal leg of the second angle 56 is flush with the top surface of the lower flanged portion 53 of the frame 13 thereby clamping the frame 13 between the horizontal legs of the first angle 54 and the second angle 56. This is just one form of clamping means for securing the present invention to an I-beam. Other types of clamping means may be utilized without affecting the performance of the present invention. Of course, similar clamping arrangements are possible when the device is used with frames comprising J-beams or other configurations.

There may also be provided a stabilizer 18 which is disposed in a plane perpendicular to that defined by the two cross-braces 16 in order to stabilize the structure 12 from sway in the direction of the plane in which it is situated. The stabilizer 18 is secured at one end to the base 22 of a support member 14 by a bolt 59. The stabilizer 18 extends diagonally upwardly to a point on the frame 13 distal to the support member 14 where the other end of the stabilizer 18 is secured to the frame 13 by a conventional clamp or bolt 60.

Each of the support members 14 is angled slightly from vertical such that the top ends of the support members 14 are closer to each other than are their bottom ends. Thus, when the height of either of the support members 14 is adjusted, while the support system 10 is actively being used to support a structure 12, it is unnecessary to remove the support system 10 from under the structure 12 or to alter the length of either cross-brace 16. If the support members 14 were not tilted as such, when either support member 14 were raised or lowered it would be necessary to change the length each cross brace 16 so that it would adequately reach each support member 14.

It is also possible to provide extra footing for the support members 14 by securing the base 22 of each support member 14 to a pad 61 which is much larger in area than the base 22. The base 22 may be secured to the pad 61 by bolt 62 or any other conventional fastening means.

Figure 6:
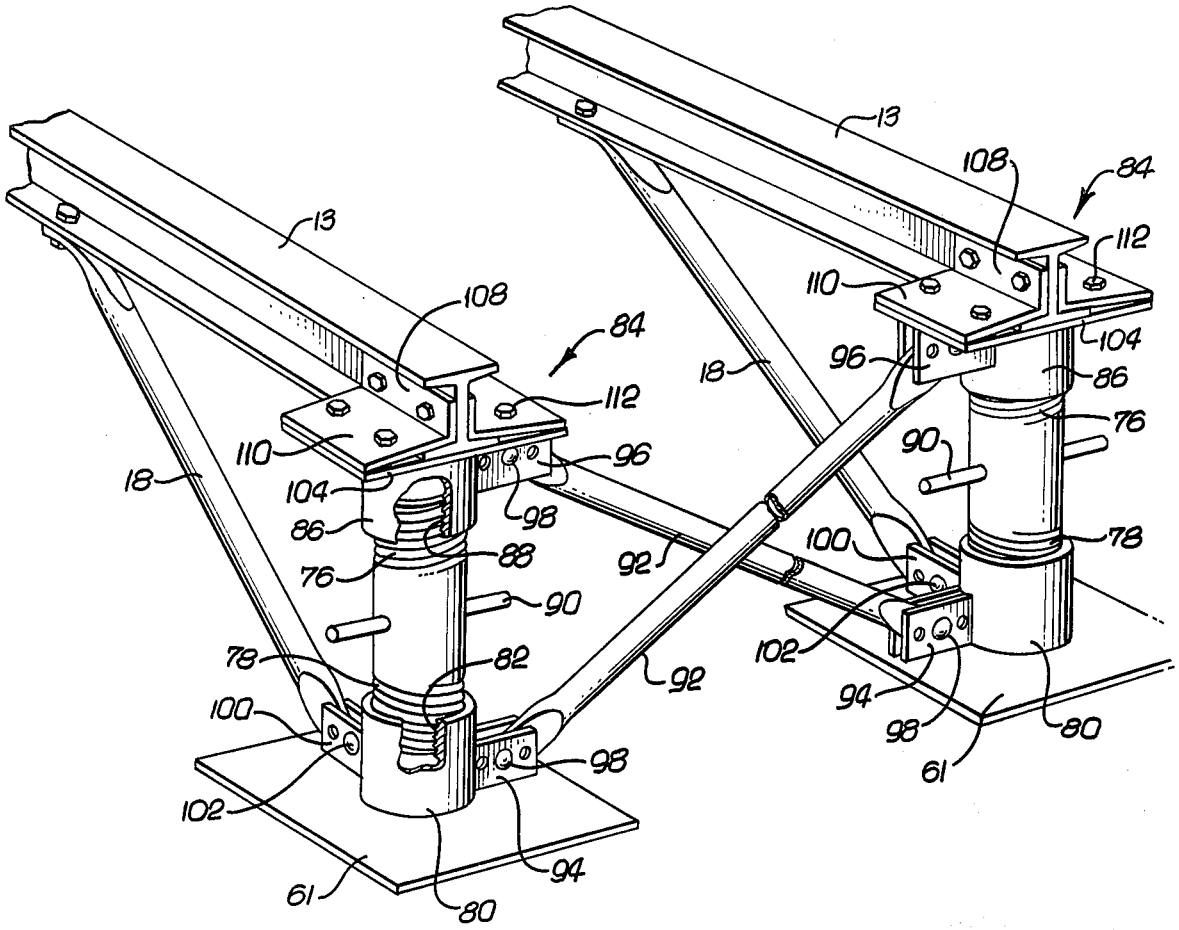
FIG. 6 is a perspective view of an alternate embodiment of the support system of the present invention.

Referring next to FIG. 6, there is shown an alternate embodiment 70 of the support system of the present invention. In the alternate embodiment 70, each support member 72 generally comprises a single cylindrical leg 74. This cylindrical leg 74 is outwardly threaded at each end with the top threads 76 being aligned in a direction opposite to the direction of the bottom threads 78. Extending upwardly from the base 61 is a lower cup 80. The lower cup 80 has inner threads 82 configured to cooperate with the bottom threads 78 of the cylindrical leg 74. The cylindrical leg 74 is thereby supported by the inner threads 82 in the lower cup 80.

As with the previously described embodiment, there is provided a clamping means 84 configured to clamp the support member 72 to the frame of the structure such as a I-beam 13. In this embodiment 70, depending from said clamping means 84 is an upper cup 86. The upper cup 86 has inner threads 88 configured to cooperate with the top threads 76 of the cylindrical leg 74.

Since the threads at the top and bottom of the cylindrical leg 74 are aligned in opposite directions, rotation of the cylindrical leg 74 about its longitudinal axis in one direction will cause the threaded ends of the cylindrical leg 74 to screw further out of both the lower cup 80 and the upper cup 86. This increases the effective height of the support member 72. Rotation of the cylindrical leg 74 in the opposite direction will cause the threads at each end of the cylindrical leg 74 to screw further into both the lower cup 80 and the upper cup 86, thereby reducing the effective height of the support member 72. By thus rotating the cylindrical leg 74 along its longitudinal axis, the height of the alternate embodiment 70 of the support system may be adjusted while the system remains secured to the structure. To facilitate the rotation of the cylindrical leg 74, a horizontal handle 90 is disposed through the cylindrical leg 74.

Also in the alternate embodiment 70, each cross-brace 92 comprises a single bar such as a steel tube. One end of each cross-brace 92 is secured to a flange 94 which extends from the lower cup 80 on one support member 72. The cross-brace 92 extends to an opposing support member 72 where the other end thereof is secured to a flange 96 which extends from the upper cup 86 of the opposing support member 72. Each of the flanges 94 and 96 has a plurality of holes 98 disposed therein. The ends of the cross-brace 92 are secured to the flanges 94 and 96 by means of a bolt which passes through one of the holes 98 in each of the flanges 94 and 96. The effective length of the cross-brace 92 may be adjusted by securing the ends to different holes 98 in the flanges 94 and 96, which holes 98 are spaced to permit such length adjustment. Of course, the flanges 94 and 96 may be secured to the base 61 or the clamping means 84 respectively or any other suitable, secure location which will provide the necessary stabilization. There may also be provided a similar flange 100 disposed at a right angle to the flange 94 extending from the lower cup 80 for connection of a stabilizer similar to that described in the previous embodiment. Similar adjustment holes 102 may also be provided in this flange 100.

The clamping means 84 of the alternate embodiment 70 comprises a flat, rectangular, horizontal plate 104 disposed at the top of the support member 72. The I-beam 13 is supported on top of the plate 104 with the ends of the plate 104 extending beyond the lengthwise edges of I-beam 13. There are also provided two L-shaped angles 106. A first leg 108 of each L-shaped angle 106 abuts the vertical portion of the I-beam 13. The second leg 110 of each L-shaped angle 106 extends beyond the lengthwise edge of the I-beam 13 and is connected to the end of the plate 104. Each L-shaped angle 106 is secured to the plate 104 by one or more bolts 112. The lower flanged portion of the I-beam 13 is thereby clamped between the two L-shaped angles 106 and the plate 104. Sideways motion of the I-beam 13 is limited by the clamping action of the first legs 108 of the two L-shaped angles 106.

It is to be understood that the specific examples of clamping means and securing means for cross-braces are for illustration only. It is possible to alter the specific types of clamping means, etc., without departing from the spirit or scope of the invention. For example, the clamping means described in conjunction with the alternate embodiment 70 may also be used with the first described embodiment. Also, it is possible that the lower ends of the support members described may be embedded directly in a concrete foundation rather than secured to a separate pad or base.

Figure 4:
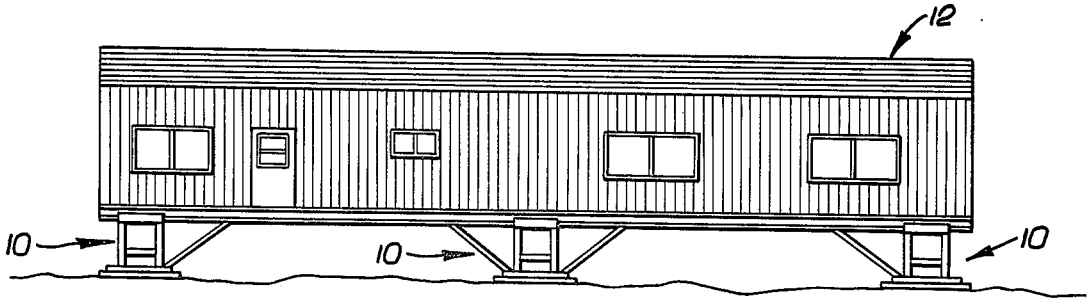
FIG. 4 is an elevational view of the support system of the present invention as used to support a structure as viewed from one side of the structure.
Figure 5:
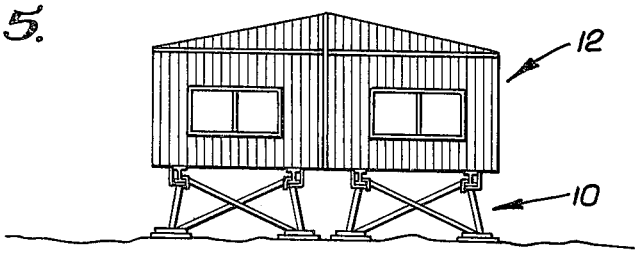
FIG. 5 is an elevational view of the support system of the present invention when used to support a structure as viewed from one end of the structure.

Thus, there is provided under the present convention a support system for structures such as mobile homes, trailers and the like which is light, simple and easy to use yet is strong and easily adjustable as to height to compensate for settling of the ground beneath the structure 12 or other changes which affect the level attitude of the structure 12. Referring to FIGS. 4 and 5, there is shown an overall view of a structure as supported by a number of support systems 10 according to the present invention. As can be seen, each support system 10 may be provided with zero, one or two stabilizers for each support member depending on the location of the support member and the stabilization desired. It can also be seen that by adjusting the height of the support members of the present invention, it is an easy matter to support a structure 12 in a level configuration even on somewhat uneven ground.

While a wide variety of materials, shapes and other configurations can be used in this invention, it should be understood that changes can be made without departing from the spirit or scope thereof. This invention, therefore, is not to be limited to the specific embodiments discussed and illustrated herein.

I claim:

1. A foundation support system for structures such as mobile homes, trailers and the like having generally parallel frame members on the underside thereof comprising:

two generally vertical main support members, each having a base disposed at the bottom thereof and means for gripping and supporting one of said frame members on the underside of said structure disposed at the top thereof, each said support member further comprising:

two or more generally vertical tubular legs slideably disposed on an equal number of support legs which extend upwardly from said base, wherein said gripping means is disposed across the top ends of said tubular legs, and a generally horizontal member disposed between said tubular legs, said horizontal member having one or more holes disposed vertically therethrough;

two diagonal cross-braces each having a means at one end thereof configured to be secured to the gripping means disposed at the top of one of said support members, each said cross-brace extending from said base of one of said support members to the gripping means which is disposed at the top of the other support member; and means for adjusting the height of said support members without removing said structure from said support system said height adjusting means comprising one or more threaded bolts extending upwardly from said base through said holes in said horizontal member and two nuts disposed on each said bolt, one nut being disposed beneath said horizontal member and the other nut being disposed above said horizontal member, said horizontal member being supported by said nuts which are disposed therebelow such that by rotating said nuts, the height at which said horizontal member and thus said tubular members is secured may be adjusted.

2. A foundation support system according to claim 1 wherein said support members are angled slightly away from vertical such that their top ends are closer to each other than their bottom ends.

* * * * *